United States Patent [19]

Hagenbach et al.

[11] 4,209,550

[45] Jun. 24, 1980

[54] COATING CARRIER MATERIALS BY ELECTROSTATIC PROCESS

[75] Inventors: Robert J. Hagenbach; Robert G. Johnston, both of Rochester, N.Y.

[73] Assignee: Xerox Corporation, Stamford, Conn.

[21] Appl. No.: 650,337

[22] Filed: Jan. 19, 1976

[51] Int. Cl.[2] ..... B05D 1/06; B05D 3/02

[52] U.S. Cl. ..... 427/27; 427/180; 427/195; 427/212; 427/221; 430/108; 430/137

[58] Field of Search ..... 427/27, 180, 185, 195, 427/212, 213, 216, 221; 252/62.1 D

[56] References Cited

U.S. PATENT DOCUMENTS

| | | | |
|---|---|---|---|
| 1,911,808 | 5/1933 | Collins | 427/27 X |
| 2,644,769 | 7/1953 | Robinson | 427/27 |
| 3,849,127 | 11/1974 | Madrid et al. | 427/27 X |
| 3,856,550 | 12/1974 | Bens et al. | 427/185 X |

*Primary Examiner*—Roland E. Martin, Jr.
*Assistant Examiner*—Stuart D. Frenkel

[57] ABSTRACT

Coated carrier materials are prepared by electrostatically attracting particles of a coating material to the surface of carrier cores and then heating the carrier materials causing the coating material to fuse to the carrier material forming an adherent coating thereon. The coating material is attracted to the carrier materials by (a) rolling carrier materials down an inclined plane while spraying the carrier materials with a coating material; (b) dropping carrier materials through a cloud chamber containing a cloud of coating material particles; and (c) solids blending a mixture of carrier materials and particles of coating material.

7 Claims, 4 Drawing Figures

COATING CARRIER MATERIALS BY ELECTROSTATIC PROCESS

BACKGROUND OF THE INVENTION

This invention relates in general to electrostatographic developing materials, and, more particularly, to a process for coating carrier core materials.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,522 is known as "cascade" development. In this method, a developer material comprising relatively large carrier particles having finely-divided toner particles electrostatically clinging to the surface of the carrier particles is conveyed to and rolled or cascaded across the electrostatic latent image-bearing surface. The composition of the toner particles is so chosen as to have a triboelectric polarity opposite that of carrier particles. As the mixture cascades or rolls across the image-bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic-image bearing surface and the toner particles are drawn from the brush to the electrostatic image by electrostatic attraction.

While ordinarily capable of producing good quality images, conventional developing materials suffer serious deficiencies in certain areas. The developing materials must flow freely to facilitate accurate metering and even distribution during the development and developer recycling phases of the electrostatographic process. Some developer materials, though processing desirable properties such as proper triboelectric characteristics, are unsuitable because they tend to cake, bridge and agglomerate during handling and storage. Adherence of carrier particles to reusable electrostatographic imaging surfaces causes the formation of undesirable scratches on the surfaces during image transfer and surface cleaning steps. The tendency of carrier particles to adhere to imaging surfaces is aggravated when the carrier surfaces are rough and irregular. The coatings of some carrier particles deteriorate rapidly when employed in continuous processes which require the recycling of carrier particles by bucket conveyors partially submerged in the developer supply such as disclosed in U.S. Pat. No. 3,099,943. Deterioration occurs when portions of or the entire coating separates from the carrier core. The separation may be in the form of chips, flakes or entire layers and is primarily caused by fragile, poorly adhering coating materials which fail upon impact and abrasive contact with machine parts and other carrier particles. Carriers having coatings which tend to chip and otherwise separate from the carrier core must be frequently replaced thereby increasing expense and consuming time. Print deletion and poor print quality occur when carrier having damaged coatings are not replaced. Fines and grit formed from carrier disintegration tend to drift and form unwanted deposits on critical machine parts. Many carrier coatings having high compressive and tensile strength either do not adhere well to the carrier core or do not possess the desired triboelectric characteristics. The triboelectric and flow characteristics of many carriers are adversely affected when relative humidity is high. For example, the triboelectric values of some carrier coatings fluctuate with changes in relative humidity and are not desirable for employment in electrostatographic systems, particularly in automatic machines which require carriers having stable and predictable triboelectric values. Another factor affecting the stability of carrier triboelectric properties is the susceptibility of carrier coatings to "toner impaction". When carrier particles are employed in automatic machines and recycled through many cycles, the many collisions which occur between the carrier particles and other surfaces in the machine cause the toner particles carried on the surface of the carrier particles to be welded or otherwise forced into the carrier coatings. The gradual accumulation of permanently attached toner material on the surface of the carrier particles causes a change in the triboelectric value of the carrier particles and directly contributes to the degradation of copy quality by eventual destruction of the toner carrying capacity of the carrier.

Heretofore, electrostatographic coated carrier particles have generally been prepared by solution, immersion, spray drying, and fluidized-bed coating methods. More particularly, by conventional methods electrostatographic carrier particles are coated by preparing a solution of the coating material in a solvent and contacting the carrier cores with the coating material by dipping the carrier cores in the coating solution; by spraying the carrier cores with a coating solution; and by creating a fluidized bed of carrier cores while contacting the carrier cores with a solution or dispersion of coating material. However, these known methods all suffer from various disadvantages. That is, in these techniques, it is usually very difficult to control the amount of coating material deposited on the carrier cores. Where a particular coating material would be desirable, its use may be precluded due to solubility considerations in preparing a coating solution. These processes necessarily require the use of a solvent which must be removed from the coated carrier surface thereby leading to contamination of the atmosphere by the vapors or requiring the use of expensive and elaborate equipment for its capture. Further, carrier beads having a solution of coating material on their surfaces have a tendency to agglomerate into large masses during the drying step. In addition, selection of a suitable solvent is difficult due to safety considerations; the incompatibility of the solvent with the carrier core surface may lead to poor adhesion of the coating material to the carrier surface and subsequent loss of the carrier coating resulting in poor performance of the developer mixture. Further, the use of solvents may dissolve carrier core surfaces making uniform surface coatings unattainable. Thus, there is a continuing need for a better method of preparing electrostatographic coated carrier materials.

It is, therefore, an object of this invention to provide a method for preparing electrostatographic coated carrier materials which overcomes the above noted deficiencies.

It is another object of this invention to provide a method of preparing electrostatographic coated carrier materials which avoids the need for the use of coating solutions.

It is a further object of this invention to provide a method of preparing electrostatographic coated carrier materials without the use of solvents.

It is still a further object of this invention to provide a method of coating electrostatographic carrier materials which permits the use of substantially any coating material.

It is yet another object of this invention to provide a method of coating electrostatographic carrier materials which avoids the need for removing solvents from coating solutions and the use of drying equipment.

It is yet another object of this invention to provide coated electrostatographic carrier materials having improved coatings.

It is another object of this invention to provide developer materials having physical and chemical properties superior to those of known developer materials.

The above objects and others are accomplished, generally speaking, by electrostatically attracting at least one coating material to a carrier core material and then heating the coated core material causing the coating material to fuse and adhere to the carrier core.

In one embodiment of this invention, various coating materials may be applied to carrier core materials by a continuous process wherein electrostatically charged carrier core particles are rolled down an inclined plane. As the charged particles move down the inclined plane, a spray of oppositely charged coating material in particle form is directed at the core particles. The coated core particles are then heated causing the coating material to fuse and adhere to the carrier core. After cooling, the coated carrier particles are ready for use and may be mixed with finely-divided toner particles to form developer mixtures.

In another embodiment of this invention, electrostatically charged carrier core particles are dropped into a "cloud chamber" containing coating material particles having an electrostatic charge opposite to that of the charged carrier core particles. The "cloud chamber" may generally be a chamber wherein charged coating material particles are suspended in air or a gas stream. As the charged carrier core particles pass through the cloud of charged coating material particles, the charged coating material particles are electrostatically attracted and electrostatically adhered to the charged carrier core particles. The thus coated carrier core particles are then heated whereby the coating material particles fuse and adhere to the carrier core forming coated carrier particles.

In yet another embodiment of the process of this invention, a coating material may be applied to carrier core particles by mixing or blending particles of a coating material with carrier core particles until the carrier core particles are uniformly coated with the coating material through electrostatic attraction. The coated carrier core particles are then heated and the coating material is fused to the carrier core particles.

Thus, in accordance with the process of this invention, various coating materials and mixtures of coating materials may be electrostatically attracted to and adhered to carrier core particles followed by heating whereby the coating materials fuse into a continuous coating over the carrier core particles to form coated electrostatographic carrier beads. The electrostatographic carrier beads formed by the process of this invention have good mechanical, thermal, and electrical properties and provide excellent results when employed in electrostatographic copying and duplicating devices.

The above-described process can be conducted in any suitable apparatus wherein the carrier core particles and the particles of coating material may be electrostatically attracted to each other whereby the particles of coating material are electrostatically coated on the surface of the carrier core particles. Three such specific types of apparatus are shown in the drawings in which.

Figure 1:
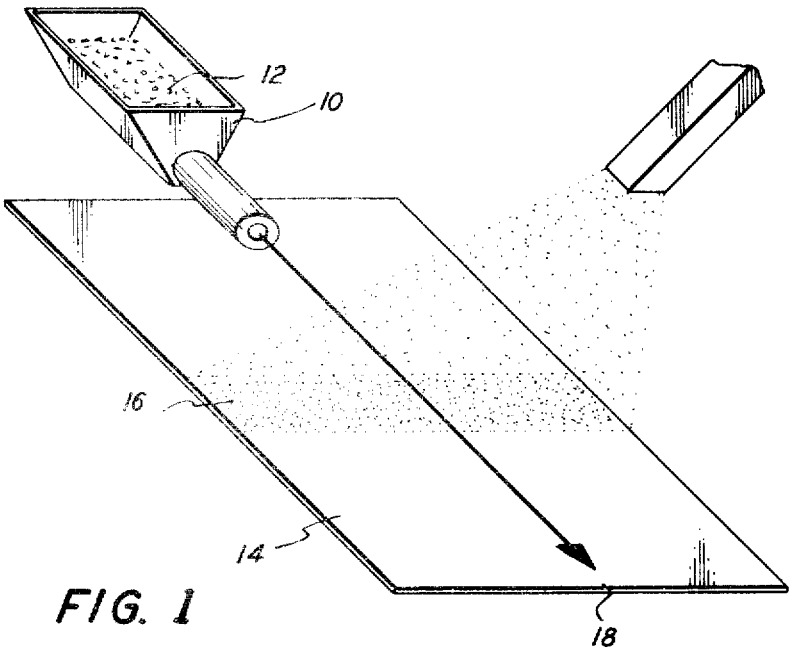
FIG. 1 is a diagrammatic representation of the apparatus which may be employed where carrier cores are rolled down an inclined plane.

Referring now to FIG. 1, said apparatus comprises a carrier core feeder 10 which may be a hopper with suitable feed control means (not shown). A supply of carrier cores 12 is loaded into core feed 10. In operation, the carrier core feed control means is activated to permit carrier cores to exit from core feeder 10 and roll down inclined plane 14. As the carrier cores roll down inclined plane 14, powder spray 16 of coating material in particle form is directed at the carrier cores. Powder spray 16 is electrostatically attracted to carrier cores 12 and forms an electrostatically-held coating on carrier cores 12. As the electrostatically coated carrier cores proceed further down inclined plane 14, they are recovered and directed to fusing means 18 (not shown) where the particles of coating material are fused to the carrier cores.

Figure 2:
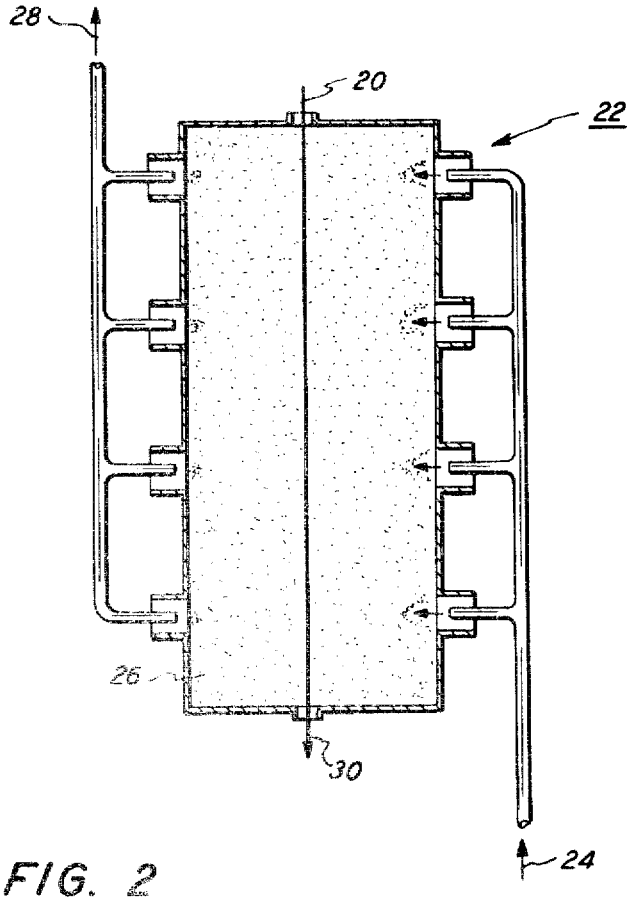
FIG. 2 is a diagrammatic representation of the apparatus which may be employed where carrier cores are treated in a "cloud chamber".

Referring now to FIG. 2, said apparatus comprises a carrier core feeder 20 with suitable gravity feed control means (not shown). Carrier core feeder 20 is located over cloud chamber 22 which generally comprises a closed cylinder having an opening for entry and exit of the carrier cores. In operation, as the carrier cores fall by gravity through cloud chamber 22, a stream of forced air or gas containing particles of coating material is introduced to cloud chamber 22 via ports 24 to form powder cloud 26. As the carrier cores pass through powder cloud 26 they are coated with particles of coating material by electrostatic attraction. In the opposite side of cloud chamber 22 are open ports 28 for collection of excess particles of coating material and passage of the stream of forced air or gas. The electrostatically coated carrier cores are directed to suitable firing means 30 (not shown) where the particles of coating material are fused to the carrier cores.

Figure 3:
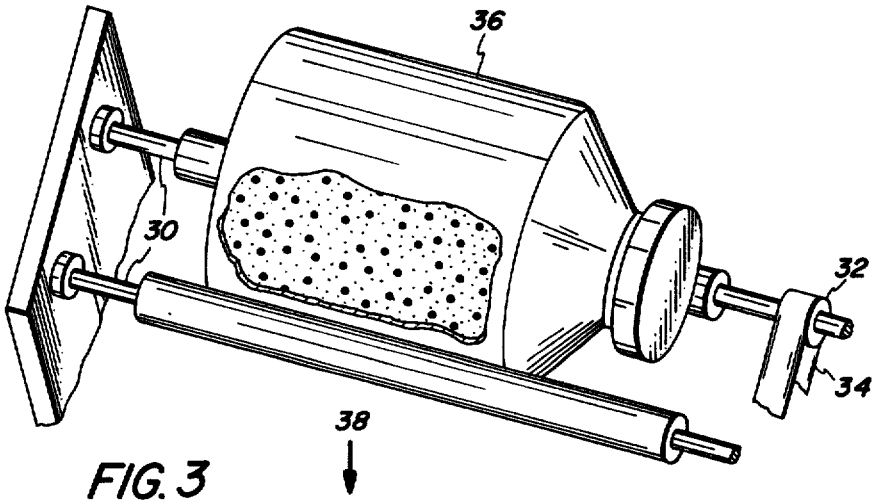
FIG. 3 is a diagrammatic representation of the apparatus which may be employed where carrier cores are treated in a blender or mixer.

Referring now to FIG. 3, said apparatus comprises a jar mill blender consisting of rubber rollers 30 one of which is adapted for rotation by shaft 32 driven by belt 34. The rollers are mounted in parallel and are separated a distance of three to five inches upon which is placed a suitable container or jar 36 containing carrier cores and particles of coating material. As jar 36 is rotated by rubber rollers 30, the carrier cores are mixed with and become electrostatically coated by the particles of coating material. When the carrier cores are uniformly coated with the coating material, the jar mill blender is stopped and the coated cores removed from jar 36. The electrostatically coated carrier cores are directed to suitable firing means 38 (not shown) where the particles of coating material are fused to the carrier cores.

Figure 4:
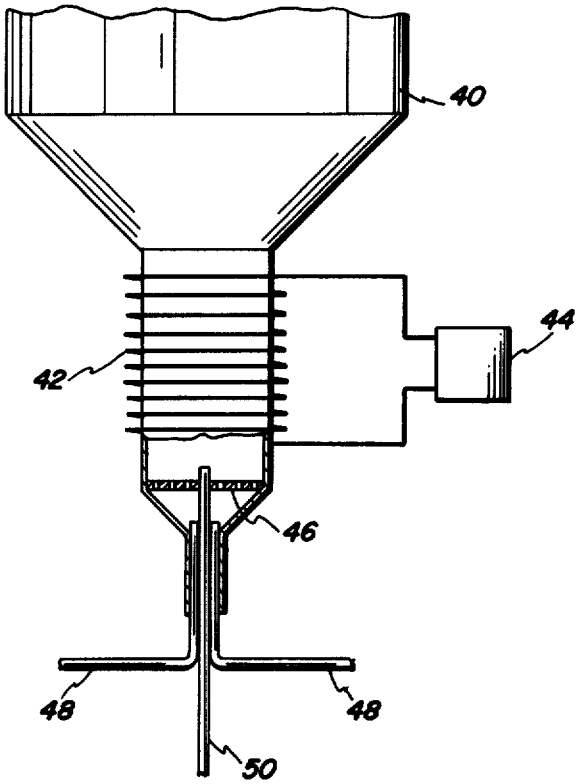
FIG. 4 is a diagrammatic representation of the apparatus which may be employed to fuse the coating material to the treated carrier cores.

Referring now to FIG. 4, said apparatus is typical of a suitable device which may be employed to fuse the particles of coating material to the carrier cores. In FIG. 4, the apparatus comprises an induction heated fluid bed wherein the coated carrier cores are placed in expansion chamber 40. Around the lower portion of the apparatus is located an induction coil 42 energized by a power source. Inside the lower portion of the chamber is positioned a dispersion plate 46 upon which the carrier cores rest when the apparatus is not in operation. In operation, fluidizing air 48 is introduced to the chamber as well as high pressure air 50 which in combination cause the carrier cores to become fluidized and experience a swirling or mixing motion to expose all surfaces of the carrier cores to the area of the heated induction coils where the carrier cores are heated and the coating material is fused to the carrier cores. The violent spouting action of the fluid bed prevents agglomeration of the carrier cores. After fusion, the coated carrier cores are allowed to cool and then removed from the apparatus.

Any suitable well known coated or uncoated electrostatographic carrier bead material may be employed as the core for the carrier particles of this invention. Typical carrier core materials include sodium chloride, ammonium chloride, aluminum potassium chloride, Rochelle salt, sodium nitrate, potassium chlorate, granular zircon, granular silicon, methyl methacrylate, glass, silicon dioxide, flintshot, iron, steel, ferrite, nickel, Carborundum, and mixtures thereof. Many of the foregoing and other typical carriers are described by L. E. Walkup in U.S. Pat. No. 2,618,551; L. E. Walkup et al in U.S. Pat. No. 2,638,416 and E. N. Wise in U.S. Pat. No. 2,618,552. The carrier materials which are preferred in accordance with this invention include ferromagnetic materials such as nickel, steel, iron, ferrites and the like. In addition, carrier materials which are nonferromagnetic are also suitable in accordance with this invention and include glass, sand, and the like. The surface of the carrier core material may be irregular, spherical, smooth, or rough, and the carrier material may be solid or hollow. An ultimate coated carrier bead diameter of between about 30 microns and about 1,000 microns is preferred for electrostatographic use because the coated carrier bead then possesses sufficient density and inertia to avoid adherence to the electrostatic latent image during the cascade or magnetic brush development process.

Any suitable well-known carrier coating material may be employed for coating the carrier core materials of this invention. Typical carrier coating materials include natural resin, thermoplastic resin, or partially cured thermosetting resin. Typical, natural resins include: caoutchouc, colophony, copal, dammar, dragon's blood, jalop, storax, and mixtures thereof. Typical thermoplastic resins include: the polyolefins such as polyethylene, polypropylene, chlorinated polyethylene, and chlorosulfonated polyethylene; polyvinyls and polyvinylidenes such as polystyrene, polymethylstyrene, polymethylmethacrylate, polyacrylonitrile, polyvinylacetate, polyvinylalcohol, polyvinylbutyral, polyvinylchloride, polyvinylcarbazole, polyvinyl ethers, and polyvinyl ketones; fluorocarbons such as polytetrafluoroethylene, polyvinylfluoride, polyvinylidene fluoride; and polychlorotrifluoroethylene; polyamides such as polycaptrolactamo and polyhexamethylene adipimide; polyesters such as polyethylene terephthalate; polyurethanes; polysulfides; polycarbonates; and mixtures thereof. Typical thermosetting resins include: phenolic resins such as phenol formaldehyde, phenol furfural and resorcinol formaldehyde; amino resins such as urea formaldehyde and melamine formaldehyde; polyester resins; epoxy resins; and mixtures thereof. A styrene-methylmethacrylate copolymer carrier coating composition is particularly preferred because of its excellent electrostatographic characteristics. In order to conduct the process of the present invention, all that is required is that the coating material be a heat-softenable or meltable material. In short, practically any minute carrier material may be employed provided only that a meltable adhesive coating material is available which will wet the carrier core material and adhere to it. Thus, coating materials with practically any melting or fusing point temperature can be selected with only the requirement that the carrier core material and the coating material survive any temperature extremes required in practice of the coating process.

Heat may be added to the carrier core material bearing the electrostatically clinging coating material by any means convenient or available; care being required only to guard against damaging the carrier material or the coating material by excessive temperature. Some care should be taken to avoid raising the temperature to a point that the coating material is decomposed or is rendered too flowable. In any event, sufficient heat should be applied to the carrier particles to cause the coating material to either fuse to the carrier material or become flowable to points of contact between the particles of coating material themselves and the carrier material. In some cases, it may be desirable to pre-heat the carrier core material to improve the initial adhesion of the coating material to the carrier material. Cooling of the coated carrier particles may be achieved in any convenient manner such as by immersion is some ambient cooling liquid or simply by permitting the heated carrier particles to exist in an atmosphere having a temperature below the melting or softening point of the coating material.

Any suitable coating thickness may be applied to the carrier cores. However, a carrier coating having a thickness at least sufficient to form a thin continuous film on a substrate is preferred because the carrier coating will then possess sufficient thickness to resist abrasion and prevent pinholes which adversely affect the triboelectric properties of the coated carrier particles. Generally, the carrier coating material may comprise from about 0.01 percent to about 1.0 percent by weight based on the weight of the coated carrier particles. Preferably, the electrostatographic carrier coating material should comprise from about 0.1 percent to about 0.6 percent by weight based on the weight of the coated carrier particles because maximum durability, triboelectric response, and copy quality are achieved. To achieve further variation in the properties of the coating materials, well-known additives such as plasticizers, reactive and non-reactive polymers, dyes, pigments, wetting agents, and mixtures thereof may be mixed with the carrier coating material. Where a partially polymerized linear or crosslinked prepolymer is to be used as the coating material, polymerization may be completed in situ on the surface of the carrier by application of heat. To achieve further variation in the properties of the final coated carrier product, well-known non-reactive additives such as plasticizers, resins, dyes, pigments, wetting agents and mixtures thereof may be mixed with the coating material.

Any suitable pigmented or dyed electroscopic toner material may be employed with the coated carriers of this invention. Typical toner materials include: gum sandarac, rosin, cumaroneindene resin, asphaltum, gilsonite, phenol-formaldehyde resins, methacrylic resins, polystyrene resins, polypropylene resins, epoxy resins, polyethylene resins, and mixtures thereof. The particular toner material to be employed obviously depends upon the separation of the toner particles from the coated carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. 25,136 to Carlson and U.S. Pat. No. 2,788,288 to Rheinfrank et al. These toners generally have an average particle diameter between about 1 and about 30 microns.

Any suitable toner concentration may be employed with the coated carriers of this invention. Typical toner concentrations for cascade and magnetic brush development systems include about 1 part toner with about 10 to about 400 parts by weight of carrier.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Greene Ozalate, lampblack, Rose Bengal, Monastral Red, Sudan Black BM, and mixtures thereof. The pigment or dye should be present in the toner in a sufficient quantity to render it highly colored so that it will form a clearly visible image on a recording member. Preferably, the pigment is employed in an amount of from about 3 percent to about 20 percent, by weight, based on the total weight of the colored toner because high quality images are obtained. If the toner colorant employed is a dye, substantially smaller quantities of colorant may be used.

Any suitable organic or inorganic photoconductive material may be employed as the recording surface with the coated carriers of this invention. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfoselenide and mixtures thereof. Typical organic photoconductors include: guinacridone pigments, phthalocyanine pigments, triphenylamine, 2,4-bis(4,4'-diethylamino-phenol)-1,3,4-oxadiazol, N-isopropylcarbazol, triphenylpyrrol, 4,5-diphenylimidazolidinone, 4,5-diphenyl-imidazolidinethione, 4,5-bis-(4'-aminophenyl)-imidazolidinone, 1,5-dicyanonaphthalene, 1,4-dicyanonaphthalene, aminophthalodinitrile, nitrophthalodinitrile, 1,2,5,6-tetraazacyclooctatetraene-(2,4,6,8), 2-mercaptobenzothiazole-2-phenyl-4-disphenylidene-oxazolone, 6-hydroxy-2,3-di(p-methoxyphenyl)-benzofurane, 4-dimethylaminobenzylidene-benzhydrazide, 3-benzylidene-amino-carbazole, polyvinyl carbazole, 1,2,4-triazine, 5-diphenyl-3-methylene-pyrazoline, 2-(4'dimethylamino phenyl)-benzoxazole, 3-amino-carbazole, and mixtures thereof. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The advantages of this invention are numerous. As will be apparent, this invention enables the use of mixtures of particles of coating materials in order to design a specific characteristic into an electrostatographic carrier coating such as a particular electrical resistivity or a particular triboelectric charging potential or polarity. For example, it was found that by varying the proportions of polyvinylidene fluoride and styrene-methylmethacrylate in a powder mixture the triboelectric charging value of the resulting coated carrier particles can be controlled with a linear triboelectric relationship developed based upon proportions of the powder mixture. In addition, the process of this invention has been found to provide coated carrier particles having a higher degree of coating coverage resulting in more uniform and more responsive triboelectric charging properties. In turn, such carrier particles lead to longer developer life and increase the time interval for replacement of the carrier materials. Further, the carrier materials of this invention are less susceptible to fracture of their coatings and have lessened tendencies to chip or flake.

Further advantages of this invention includes the feasibility of applying coating materials to electrostatographic carrier cores where the coating materials are insoluble or difficult to solubilize in available solvents. In addition, the use of coating solvents is eliminated thereby reducing expense and avoiding problems relating to recovery of the solvents. Thus, this invention permits the use of practically any desired material as a coating for electrostatographic carrier cores.

The following examples further define, describe and compare methods of preparing the carrier materials of the present invention and of utilizing them to develop electrostatic latent images. Parts and percentages are by weight unless otherwise indicated.

EXAMPLE I

About 800 grams of steel carrier cores having an average diameter of about 275 microns which were classified as to shape by passing through a cleland spiral separator (available from Cleland Manufacturing Co., Minneapolis, Minn.) to remove non-rounds and flakes were placed in a feeder as shown in FIG. 1 and introduced to a grounded metal planar surface inclined at about 10°. The feed rate of the cores to the inclined planar surface was at a rate of about 50 grams per minute. As the cores rolled down the inclined plane, a spray of polyvinylidene fluoride particles having an average particle diameter of about 1 micron was directed at the core material at the rate of about 1 gram per minute. The plastic powder particles were attracted to the core material by electrostatic forces producing a uniform coating of plastic powder which enveloped the core material. The core material bearing the electrostatically held plastic powder particles was then heated at a temperature of about 750° F. for a period of about 5 minutes and then cooled. After cooling, it was found that the plastic powder particles had melted and become fused to the steel carrier cores to form a substantially continuous coating thereon.

A developer mixture is produced by mixing about one part colored styrene-n-butyl methacrylate copolymer toner particles having an average diameter of about 15 microns with about 99 parts of the coated carrier particles prepared above. In machine tests employing cascade development of a positively charged reusable imaging surface, the developer performs well and print quality is good throughout the test. No carrier coating abrasion is observed.

EXAMPLE II

About 800 grams of steel carrier cores having an average diameter of about 600 microns were classified as in Example I. The steel carrier cores were then placed in a feeder as shown in FIG. 1 and introduced to a grounded metal planar surface inclined at about 10°. The feed rate of the cores to the inclined planar surface was at a rate of about 50 grams per minute. As the charged cores rolled down the inclined plane, a spray of polyvinylidene fluoride particles having an average particle diameter of about one micron was directed at the core material at the rate of about 5 grams per minute. The plastic powder particles were attracted to the core material by electrostatic forces producing a uniform coating of plastic powder which enveloped the core material. The core material bearing the electrostatically held plastic powder particles was then heated at a temperature of about 750° F. for a period of about 5 minutes and then cooled. After cooling, it was found that the plastic powder particles had melted and become fused to the steel carrier cores to form a substantially continuous coating thereon.

A developer mixture is produced by mixing about one part colored styrene-n-butyl methacrylate copolymer toner particles having an average diameter of about 15 microns with about 99 parts of the coated carrier particles prepared above. In machine tests employing cascade development of a positively charged reusable imaging surface, the developer performs well and print quality is good throughout the test. No carrier coating abrasion is observed.

EXAMPLE III

About 1,000 grams of steel carrier cores having an average diameter of about 250 microns were classified as in Example I. The carrier cores were then charged and dropped into a "powder cloud chamber" as shown in FIG. 2 at a rate of about 25 grams per minute. The powder cloud in the chamber consisted of styrene-n-butyl methacrylate (65:35) copolymer particles having an average particle diameter of about 10 microns suspended in a moving stream of air. As the charged carrier cores fall through the cloud of suspended plastic particles, electrostatic forces cause the plastic particles to be attracted to the charged carrier cores and envelope them. The core material bearing the electrostatically held plastic powder particles was then heated at a temperature of about 500° F. for a period of about 3 minutes and then cooled. After cooling, it was found that the plastic powder particles had melted and become fused to the steel carrier cores to form a substantially continuous coating thereon.

A developer mixture is produced by mixing about one part colored styrene-n-butyl methacrylate copolymer toner particles having an average diameter of about 15 microns with about 99 parts of the coated carrier particles prepared above. In machine tests employing cascade development of a positively charged reusable imaging surface, the developer performs well and print quality is good throughout the test. No carrier coating abrasion is observed.

EXAMPLE IV

About 1,000 grams of steel carrier cores having an average diameter of about 600 microns were classified as in Example I. The carrier cores were then charged and dropped into a "powder cloud chamber" as shown in FIG. 2 at a rate of about 25 grams per minute. The powder cloud in the chamber consisted of styrene-n-butyl methacrylate (65:35) copolymer particles having an average particle diameter of about 10 microns suspended in a moving stream of air. As the charged carrier cores fall through the cloud of suspended plastic particles, electrostatic forces cause the plastic particles to be attracted to the charged carrier cores and envelope them. The core material bearing the electrostatically held plastic powder particles was then heated at a temperature of about 500° F. for a period of about 3 minutes and then cooled. After cooling, it was found that the plastic powder particles had melted and become fused to the steel carrier cores to form a substantially continuous coating thereon.

A developer mixture is produced by mixing about one part colored styrene-n-butyl methacrylate copolymer toner particles having an average diameter of about 15 microns with about 99 parts of the coated carrier particles prepared above. In machine tests employing cascade development of a positively charged reusable imaging surface, the developer performs well and print quality is good throughout the test. No carrier coating abrasion is observed.

EXAMPLE V

About 1,000 grams of steel carrier cores having an average diameter of about 250 microns were classified as in Example I. The steel cores were then placed in a blender as shown in FIG. 3 along with about 11 grams of polyvinylidene fluoride particles having an average diameter of about 1 micron. The steel cores and the polyvinylidene fluoride particles were mixed in the container for about 60 minutes after which time the steel cores were uniformly coated with particles of the polyvinylidene fluoride powder. The steel cores bearing the electrostatically held polyvinylidene fluoride powder particles were then heated with a heat gun until the powder became fused to the cores. After cooling, it was found that the polyvinylidene fluoride particles had melted and become fused to the carrier cores to form a substantially continuous coating thereon.

A developer mixture is produced by mixing about one part colored styrene-n-butyl methacrylate copolymer toner particles having an average diameter of about 15 microns with about 99 parts of the coated carrier particles prepared above. In machine tests employing cascade development of a positively charged reusable imaging surface, the developer performs well and print quality is good throughout the test. No carrier coating abrasion is observed.

EXAMPLE VI

About 1,000 grams of steel carrier cores having an average diameter of about 250 microns were classified as in Example I. The steel cores were then placed in a blender as shown in FIG. 3 along with about 10 grams of styrene-methyl methacrylate (15:85) copolymer powder particles having an average diameter of about 7 microns. The steel cores and the powder particles were mixed in the blender for about 60 minutes after which time the steel cores were uniformly coated with particles of the styrene-methyl methacrylate powder. The steel cores bearing the electrostatically held powder particles were then heated until the powder fused completely to the steel cores. After cooling, it was found that the plastic powder particles had melted and become fused to the carrier cores to form a substantially continuous coating thereon.

A developer mixture is produced by mixing about one part colored styrene-n-butyl methacrylate copolymer toner particles having an average diameter of about 15 microns with about 99 parts of the coated carrier particles prepared above. In machine tests employing cascade development of a positively charged reusable imaging surface, the developer performs well and print quality is good throughout the test. No carrier coating abrasion is observed.

Although specific materials and conditions were set forth in the above exemplary processes in making and using the developer material of this invention, these are merely intended as illustrations of the percent invention. Various other toners, carrier cores, substituents and processes such as those listed above may be substituted for those in examples with similar results.

Other modifications of the present invention will occur to those skilled in the art upon a reading of the present disclosure. There are intended to be included within the scope of this invention.

What is claimed is:

1. A method of preparing coated electrostatographic carrier particles having an average particle diameter of from between about 30 and about 1,000 microns consisting of rolling carrier cores down an inclined plane, spraying said rolling carrier cores with a spray of oppositely charged polymer resin coating material in particle form whereby said coating material is electrostatically attracted to said carrier cores, and heating the electrostatically coated carrier cores until said coating material is fused to said carrier cores, said carrier cores being selected from the group consisting of nickel, steel, iron, and ferrites, and wherein said coating material is present in an amount of from about 0.01 percent to about 1.0 percent by weight based on the weight of said coated carrier particles.

2. A method of preparing coated electrostatographic carrier particles in accordance with claim 1 wherein said coating material is fused into a substantially continuous coating over said carrier cores.

3. A method of preparing coated electrostatographic carrier particles in accordance with claim 1 wherein said carrier particles are characterized as possessing good mechanical, thermal, and electrical properties for use in electrostatographic copying and duplicating devices.

4. A method of preparing coated electrostatographic carrier particles in accordance with claim 1 wherein said coating material is polyvinylidene fluoride.

5. A method of preparing coated electrostatographic carrier particles in accordance with claim 1 wherein said coating material is a copolymer of styrene and methyl methacrylate.

6. A method of preparing coated electrostatographic carrier particles in accordance with claim 1 wherein said coating material is a thermoplastic resin.

7. A method of preparing an electrostatographic developer mixture consisting of mixing finely-divided toner particles with coated carrier particles having an average particle diameter of from between about 30 and about 1,000 microns, said coated carrier particles having been prepared by rolling carrier cores down an inclined plane, spraying said rolling carrier cores with a spray of oppositely charged polymer resin coating material in particle form whereby said coating material is electrostatically attracted to said carrier cores, and heating the electrostatically coated carrier cores until said coating material is fused to said carrier cores, said carrier cores being selected from the group consisting of nickel, steel, iron, and ferrites, and wherein said coating material is present in an amount of from about 0.1 percent to about 1.0 percent by weight based on the weight of said coated carrier particles.

* * * * *